US005081039A

United States Patent [19]

Buttke et al.

[11] Patent Number: 5,081,039

[45] Date of Patent: Jan. 14, 1992

[54] PROCESS FOR MAKING CATALYST INVENTORY MEASUREMENTS AND CONTROL PROCEDURE FOR ADDING OR WITHDRAWING CATALYST

[75] Inventors: Robert D. Buttke, Naperville, Ill.; Norman K. McDaniel, Dickinson, Tex.

[73] Assignee: Amoco Corporation, Chicago, Ill.

[21] Appl. No.: 438,337

[22] Filed: Nov. 16, 1989

[51] Int. Cl.[5] ..... G01N 1/00

[52] U.S. Cl. ..... 436/55; 422/140; 422/105; 208/143; 208/153

[58] Field of Search ..... 422/140, 105; 436/55; 208/143, 153

[56] References Cited

U.S. PATENT DOCUMENTS 4,750,989 6/1988 Soderberg ..... 422/219

4,902,407 2/1990 Chan et al. ..... 208/143

*Primary Examiner*—David L. Lacey

*Assistant Examiner*—Abanti B. Singla

*Attorney, Agent, or Firm*—Thomas W. Tolpin; William H. Magidson; Ralph C. Medhurst

[57] ABSTRACT

The inventive procedure more accurately maintains an inventory of a catalyst in an ebullated bed of a reactor in an oil refinery, especially a resid hydrotreating unit. The ebullated catalyst bed has therein three phases (catalyst, oil, gas). A first density measurement is made of the two-phase mixture in a freeboard zone i.e. in a catalyst free area above the ebullated catalyst. A second density measurement is made in the catalyst bed where all three phases are present. Density measurements are used, along with values for vapor, liquid, and soaked particle densities and corrections for gamma-ray absorption coefficients, to calculate the catalyst particle holdup in the vessel. From this, the amount of catalyst actually in the reactor can be calculated. Once this amount is known, fresh catalyst may be added to or spent catalyst may be removed from the reactor in order to maintain a fixed catalyst inventory within the catalyst bed.

19 Claims, 4 Drawing Sheets

$$\ln\left(\frac{I}{I_0}\right) = \sum_I \mu_I P_I L_I$$

WHERE $I_0$ = INCIDENT RADIATION $I$ = ATTENUATED RADIATION $\mu_I$ = ABSORPTION COEFFICIENT $P_I$ = DENSITY $L_I$ = SAMPLE LENGTH $$\ln\left(\frac{I}{I_0}\right) = \sum_i \mu_i P_i L_i$$

WHERE $I_0$ = INCIDENT RADIATION $I$ = ATTENUATED RADIATION $\mu_i$ = ABSORPTION COEFFICIENT $P_i$ = DENSITY $L_i$ = SAMPLE LENGTH

PROCESS FOR MAKING CATALYST INVENTORY MEASUREMENTS AND CONTROL PROCEDURE FOR ADDING OR WITHDRAWING CATALYST

This invention relates to catalyst inventory measurements and control procedure. More particularly, it relates to processes for determining the amount of catalyst in an expanded-bed at a resid hydrotreating unit ("RHU") in a petroleum refinery without having to shut down the RHU.

Reference is made to U.S. Pat. No. 4,750,989, which shows and describes a process for measuring the catalyst inventory in an ebullating (expanded) bed reactor. As explained in this patent, it is necessary to monitor a reactor in order to know how much catalyst is present, when to withdraw spent catalyst, and when to add new, fresh, and unspent catalyst. Monitoring the catalyst inventory in a reactor has always been difficult. Catalyst replacement models can keep an account of the apparent inventory based on the volume of fresh catalyst added and the volume of spent catalyst withdrawn. However, apparent inventories based on such calculations drift over time because of catalyst attrition, catalyst elutriation, or addition and withdrawal of unequal batches of catalyst.

In essence, this U.S. Pat. No. 4,750,989 teaches a use of simple measurements at each of a plurality of levels in the reactor in order to detect when catalyst inventory exceeds or falls below target values. The measurements of catalyst inventory is made by at least two density meters at different levels. From the resulting signals, an addition or withdrawal of the catalyst may be made in order to maintain a more stable inventory of catalyst within the reactor.

However, a simple catalyst level measurement alone cannot indicate the inventory of catalyst in the reactor. Recycle liquid flow rates can be increased as necessary to raise any inventory of catalyst to the desired control level. Thus there is a need for a better way to calculate inventory and to indicate when to add or withdraw catalyst.

Accordingly, an object of the invention is to provide new and improved inventory control procedures for adding or withdrawing the catalyst in a resid reactor in order to maintain a desired inventory of catalyst.

Another object of the invention is to simplify catalyst inventory control and the addition into and withdrawal of catalyst from a reactor.

Still another object of the invention is to improve the predictability of RHU product yields and qualities and to better utilize the catalyst used during refining of the oil.

Still another object is to make use of measurements currently taken inside reactor without introducing new equipment.

In keeping with an aspect of this invention, these and other objects are accomplished by a procedure which more accurately monitors the inventory of catalyst in the reactor of an expanded-bed resid hydrotreating reactor. The procedure begins with a calculation of the effective volume of the reactor which is the exact volume inside a reactor shell, based on its inside measurements, from which the volume of the recycle line and plenum (space below distributor grid) is subtracted. A first density measurement is made in the freeboard zone of the reactor, i.e. in an area above the catalyst bed. A second density measurement is made in the catalyst bed.

By the inventive procedure, the first measurement is compared to the second, and the catalyst inventory is calculated based on the comparison. The resulting value is the amount of catalyst actually in the reactor. Once this amount is known, fresh catalyst may be added to or spent catalyst may be removed from the reactor in order to maintain a fixed catalyst inventory.

BRIEF DESCRIPTION OF THE DRAWINGS

The invention may be better understood by a reference to the attached drawings, in which:

FIG. 1 is a cross-section of an ebullated (expanded) bed reactor that is taken from U.S. Pat. No. 4,750,989, which may be consulted if additional details are required. High-sulfur resid oil feed, also referred to as vacuum-reduced crude, comprising 1,000+° F. resid and heavy gas oil, is fed into reactor 10 along with a hydrogen-rich feed gas. A cascaded series or set of these reactors form a resid hydrotreating unit or one reactor train in parallel with other trains.

In the reactors, the resid is hydroprocessed (hydrotreated) in the presence of fresh or equilibrium hydrotreating catalyst and hydrogen in order to produce an upgraded effluent product stream with reactor tail gases (effluent off gases), leaving used and spent catalyst. The input oil feed at 14 typically comprises resid oil (resid) and heavy gas oil. The output effluent product stream typically comprises light hydrocarbon gases, hydrotreated naphtha, distillates, light and heavy gas oil, and unconverted hydrotreated resid.

Figure 1:
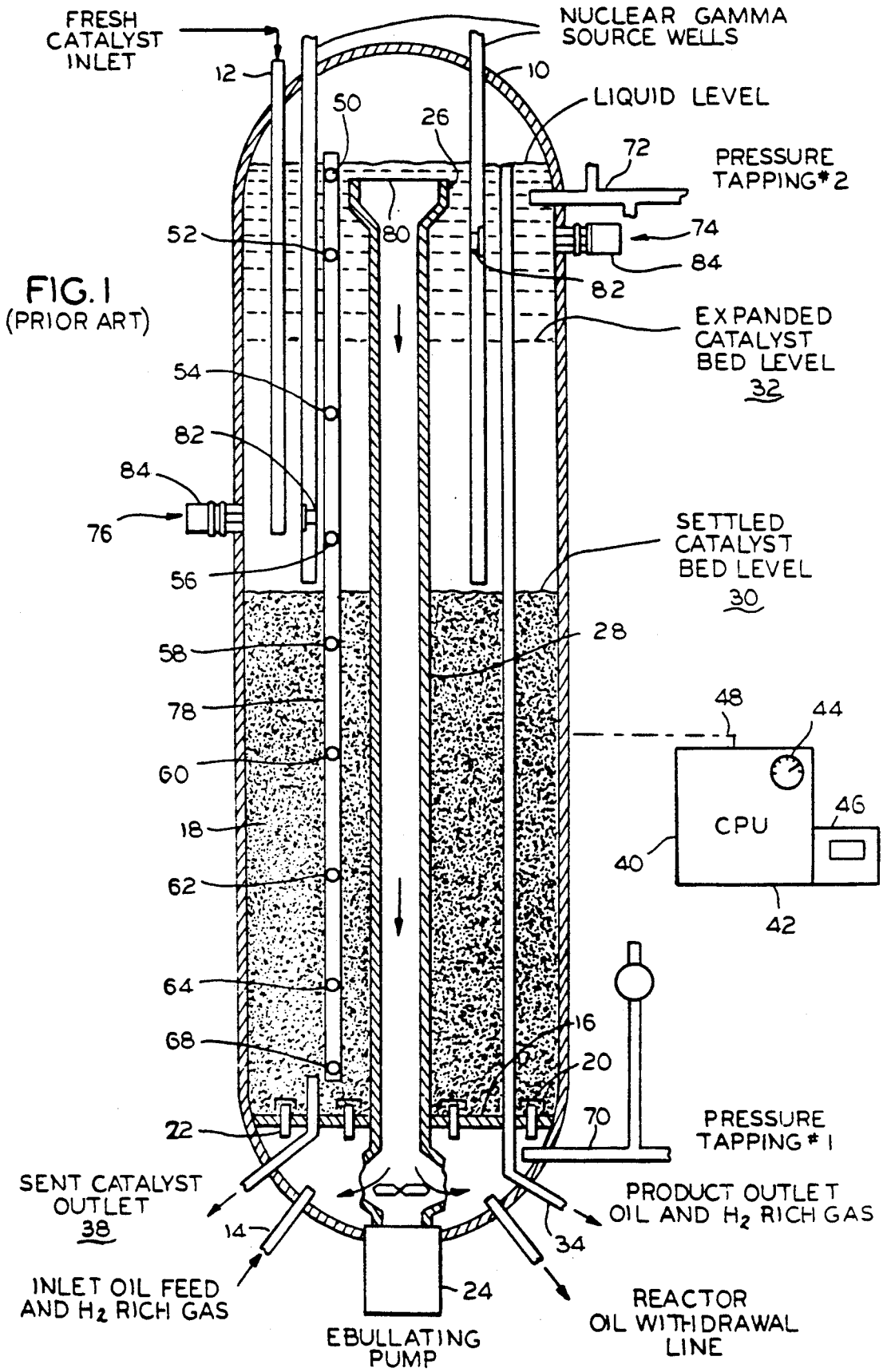
FIG. 1 (PRIOR ART)
FIG. 1 is a cross-section of a reactor used in an oil refining system and more particularly in a resid hydrotreating unit.

More particularly, as shown in FIG. 1, a fresh hydrotreating catalyst is fed downwardly into the top of ebullated bed reactor 10 via fresh catalyst feed line 12. Hot resid feed and hydrogen-containing feed gases enter the bottom of the reactor 10 via feed line 14 and flow upwardly through a distributor plate or grid 16 into a catalyst bed 18. Preferably, the resid feed, is pre-heated in an external oil heater. The hydrogen-containing feed gas is pre-heated in a hydrogen heater before being combined and fed through the feed line 14 and into the first reactor. The distributor plate or grid 16 contains numerous bubble caps 20 and risers 22 which help to prevent channeling and to distribute the oil and the gas across the catalyst bed. Grid 16 also prevents the catalyst from falling into the bottom section of the reactor.

Usually the hydrotreating catalyst comprises a hydrogenating component carried on a porous refractory, inorganic oxide support that is formed into pellets or particles which have an appearance somewhat similar to that of very coarse sand. In a large refinery, many tons of this catalyst are transported into, out of, and replaced in the ebullated bed reactors daily.

Catalyst particles in reaction zone 18 are suspended in a three-phase mixture of catalyst, oil, and hydrogen-rich feed gas, (i.e. the reaction zone 18 of the reactor is between grid 16 and the top of expanded catalyst bed level 32). Typically, hydrogen-rich feed gas bubbles continuously through the oil. The random ebullating motion of the catalyst particles results in a turbulent mixture of the three phases which promotes good contact mixing and minimizes temperature gradients. As will become more apparent, the inventive process subtracts the contribution of oil and gas phases from the measured three-phase density in order to determine how much catalyst (solid phase) is present.

The resulting fluid state of the ebullated hydrotreating catalyst enhances the flexibility of the ebullated bed reactors. Daily catalyst replacement results in a steady state equilibrium catalyst activity. Since the liquid resid feed does not usually have enough velocity to expand the catalyst bed above its settled level, liquid is recycled from the top of the reactor to the bottom of the reactor through a downcomer pipe and then pumped back up through the reactor at a sufficient velocity to attain the required degree of expansion. That is, an ebullating pump 24 circulates oil from a recirculation input, in the form of a recycle pan 26, through a downcomer 28 to a recirculation outlet below grid 16. The pumping energy applied to the circulating oil is high enough to lift and expand the catalyst bed 18 from an initial settled level 30 to its steady expanded state or level 32. The ebullated bed reactors generally operate at a temperature above 700° F. and at a hydrogen partial pressure greater than 1500 psi.

The effluent product stream of partially hydrotreated oil and hydrogen-rich reactor tail gases (off gases) is withdrawn from the reactor via effluent product line 34. The used and spent catalyst is withdrawn from the bottom of the reactor via spent catalyst discharge line 38.

A central processing unit (CPU) 40, comprising a computer 42 with an internal clock 44 and a plotter printer 46, are mounted in a control room of the oil refinery. The central processing unit is operatively connected by electric wires and cables 48 to suitable thermocouples (52–68) or other temperature sensing devices, as well as to lower pressure tap 70 (pressure tapping #1), upper pressure tap 72 (upper pressure tapping #2), and to density detectors 74, 76.

The thermocouples are mounted in three vertical thermowells spaced 120-degrees apart from each other, such as in thermowell 78, which are located between the wall of the reactor and the downcomer 28.

The density detectors 74 76 are standard commercial items supplied by Texas Nuclear, a subsidiary of Ramsey Engineering, P.O. Box 9267, Austin, Tex. 78766. However, it should be understood that equivalent detectors manufactured by other companies may also be used.

These density detectors 74, 76 measure the average density (mass per unit volume) of the reactor contents by passing a beam of gamma-ray radiation through the material to the detectors. As the density increases, the detected radiation decreases. The density detectors convert this decrease in detected radiation into signals representing material density. In the RHU reactors, there are other density detectors which are not shown here because they are not necessary for the inventive process.

In the preferred embodiment, the upper density detector 74 is mounted at least one foot and preferably in the range of two to six feet above the top 32 of the expanded catalyst bed 18 and at least six inches below the top edge 80 of the downcomer intake pan 26. The lower density detector 76 is preferably mounted 20 feet below the upper tangent line of the reactor at a location slightly above the top of the settled expanded catalyst bed. Actually the lower density detector 76 may be almost any place within the catalyst bed. The density detectors 74, 76 are structurally and functionally similar, serving to detect and sense the density of the material (contents) in the areas confronting the detectors.

Each of the density detectors 74, 76 comprises a gamma ray source or transmitter 82 and a gamma ray target or receiver 84. The gamma ray source 82 and target 84 of each density detector are in horizontal alignment and registration with each other. Gamma ray density detectors are preferred because they penetrate resid and gas oil better than alpha and beta rays. Cesium-137 emits 662-KEV gamma rays, so that most of the interactions with the atoms involve the atomic electrons and are due to the Compton effect. The Compton effect refers to a collision of a photon and a free electron in which the electron recoils and a photon of longer wavelength is emitted. The x-rays and gamma rays interact with matter and give an accurately calculable measurement. The rate, strength, and intensity of the gamma ray source ranges from about 1,000 to about 3,000 millicuries, and preferably about 2,000 millicuries.

For more details on the above-described equipment, reference may be made to U.S. Pat. No. 4,750,989. An advantage of the invention is that the equipment described in the patent remains largely unchanged, the inventive inventory control process being different from the process taught in the patent. In essence, the process described in the patent did little more than measure the level of the catalyst in the reaction zone while the reactor was being started up and without taking into account the variations, other than level, which might take place while the reactor was in operation.

Knowledge of gas holdup in the reactor is an important part of this invention. An analysis shows that gas holdup in the catalyst bed is the same as or slightly higher than the gas holdup above the bed (freeboard zone). The term "gas holdup" is defined as the volume of the gas within the reactor divided by the effective volume of the reactor. The effective volume of the reactor is a value based upon the gross volume of the area bounded by the inside dimension of the reactor shell less the volume of the recycle line, the reactor plenum (space below distributor grid), and the vapor space at the top of the reactor.

According to the invention, only two density meters are required. Catalyst inventory is calculated by using densities measured above and within the expanded catalyst bed. This inventive procedure may be used to monitor catalyst inventory independently of recycle pump speed, which varies with catalyst inventory and independently of an accounting model which tracks inventory based on the volume of catalyst that is added or withdrawn from the catalyst bed.

The following description of the inventive process uses the nomenclature set forth in Table A.

TABLE A -- NOMENCLATURE $\rho_6$ = Density at 6-foot level, lb/ft$^3$.
$\rho_{20}$ = Density at 20-foot level, lb/ft$^3$.
$\rho_l$ = Liquid density, lb/ft$^3$.
$\rho_s$ = Density of soaked catalyst particle, lb/ft$^3$.
$\rho_{g6}$ = Gas Holdup in freeboard (6-foot level), volume fraction.

$\epsilon_{gb}$=Gas Holdup in catalyst bed (20-foot level), volume fraction.

$\epsilon_{lb}$=Liquid holdup in catalyst bed (20-foot level), volume fraction.

$\epsilon_{l6}$=Liquid holdup in freeboard (6-foot level), volume fraction.

$\epsilon_s$=Holdup of soaked catalyst particles, volume fraction.

$U_g$=Gas superficial velocity, fps.

$\mu$=Gamma-ray absorption coefficient, $cm^2/gm$.

$k_i$=Gamma-ray absorption coefficient of phase i/absorption coefficient of calibration oil.

For convenience of expression, the following equations use "6" and "20" subscripts to indicate the six foot and twenty foot levels (below vessel tangent line) of the sensors 74, 76. A more generalized formulation may be used to designate the freeboard and expanded catalyst bed, regardless of where the sensors may be located.

The gas holdup in the freeboard is calculated from the density measured by detector 74, preferably at the 6-foot level (measured downwardly from vessel tangent line), where most of the time only two phases (gas and oil) are present. The 6-foot density is the volumetric average density of the two phases.

The inventive process involves the following eight steps.

In general the measurements should be made before the calculations. However, the order of the steps is not critical. Therefore, this disclosure and the appended claims are to be construed broadly enough to permit essentially the same steps to be carried out in a different sequence.

Step One

At the lower density detector 76, the density $\rho_{20}$ of the three phase expanded bed is measured at a convenient level, which is twenty feet down from the top in this particular example. The measured density may be defined by the equation:

$$\rho_{20}=\epsilon_{gb}\rho_g k_g+\epsilon_{lb}\rho_l k_l+\epsilon_s\rho_s k_s \quad (1)$$

where the factors:

$\epsilon_{gb}\rho_g\beta_g$ relates to the gas phase $\epsilon_{lb}\rho_e k_e$ relates to the liquid phase $\epsilon_s\rho_s k_s$ relates to the catalyst particle phase

Step Two

The particle hold up $\epsilon_s$ is calculated on a basis of the equation:

$$\epsilon_s(k_s\rho_s-\rho_l)=\rho_{20}-\rho_l+\epsilon_{gb}(\rho_l-\rho_g) \quad (2)$$

By simple algebra, this equation may be rearranged to show the hold up of the soaked particle $\epsilon_s$, as follows:

$$\epsilon_s=\frac{\rho_{20}-\rho_l+\epsilon_{gb}(\rho_l-\rho_g)}{(k_s\rho_s-\rho_l)} \quad (3)$$

Step Three

The liquid density is calculated. Liquid density may also be measured by the density meters in the freeboard during periods while the gas rates through the reactor are very low. Liquid densities will be the same in the freeboard and the bed. It is also well within the skill level of the skilled worker to calculate a liquid density, which for the RHU of U.S. Pat. No. 4,750,989 is in a range of about 30 to 50 pounds per cubic foot ($lb/ft^3$) with an average in the order of 40 $lb/ft^3$. From tests and experiments, it has been found that, for the RHU of U.S. Pat. No. 4,750,989, densities of 40 $lb/ft^3$ or slightly lower can be used for liquid density at typical operating correlations.

Observations have confirmed that densities are near 40 $lb/ft^3$. During infrequent upset condition, gas seemed to bypass the catalyst bed by flowing upwardly through the recycle downcomer line. A number of density detectors scattered through the reactor indicated values which were very close to 40 $lb/ft^3$. Since the value of this constant was about 15 $lb/ft^3$ lower than an anticipated density for a three-phase catalyst bed, a reasonable explanation for the uniform densities might be that the catalyst bed had slumped and that most gas was bypassing the catalyst bed and flowing through the downcomer. This condition provided an opportunity to observe the liquid density. The average density was about 40 $lb/ft^3$.

Step Four

Add a factor representing the vapor density ($\rho_g$). Gas density can be calculated quite easily by those skilled in the art; however, it is very difficult to measure at RHU processing conditions. Once again, as in Step Three, a constant may be used for the vapor density because it has been found that actual variations from the constant produce a negligible effect upon the final calculations. These calculations, which are well within the skill of the art, show that for the RHU of U.S. Pat. No. 4,750,989, the vapor density range is approximately 1–5 $lb/ft^3$ and the preferred constant value is in the order of 3 $lb/ft^3$.

Step Five

A factor is introduced into the calculations to correct for gamma-ray absorption ($k_s$). The density meters 74, 76 detect gamma-ray photons with a sodium-iodide scintillation crystal and a photomultiplier tube. The following equation defines the relationship between radiation at the source and at the detector $$\ln\frac{I}{I_0}=\Sigma-\mu_i\rho_i L_i \quad (4)$$

where

I=radiation at detector.

$I_o$=radiation at source.

$\mu_i$=absorption coefficient of phase i.

$\rho_i$=density of phase i.

$L_i$=path length of phase i.

For most elements, the mass absorption coefficient varies within a narrow range of 0.071–0.078 $cm^2/gm$. However, hydrogen is an exception with a coefficient of 0.154, which is about double the coefficient of the other elements. Because hydrogen has a high ratio of atomic electrons to elemental mass, it has a high absorption coefficient. Therefore, some correction must be introduced into the calculations to account for the different hydrogen concentration of the phases in the reactor.

Figure 2:
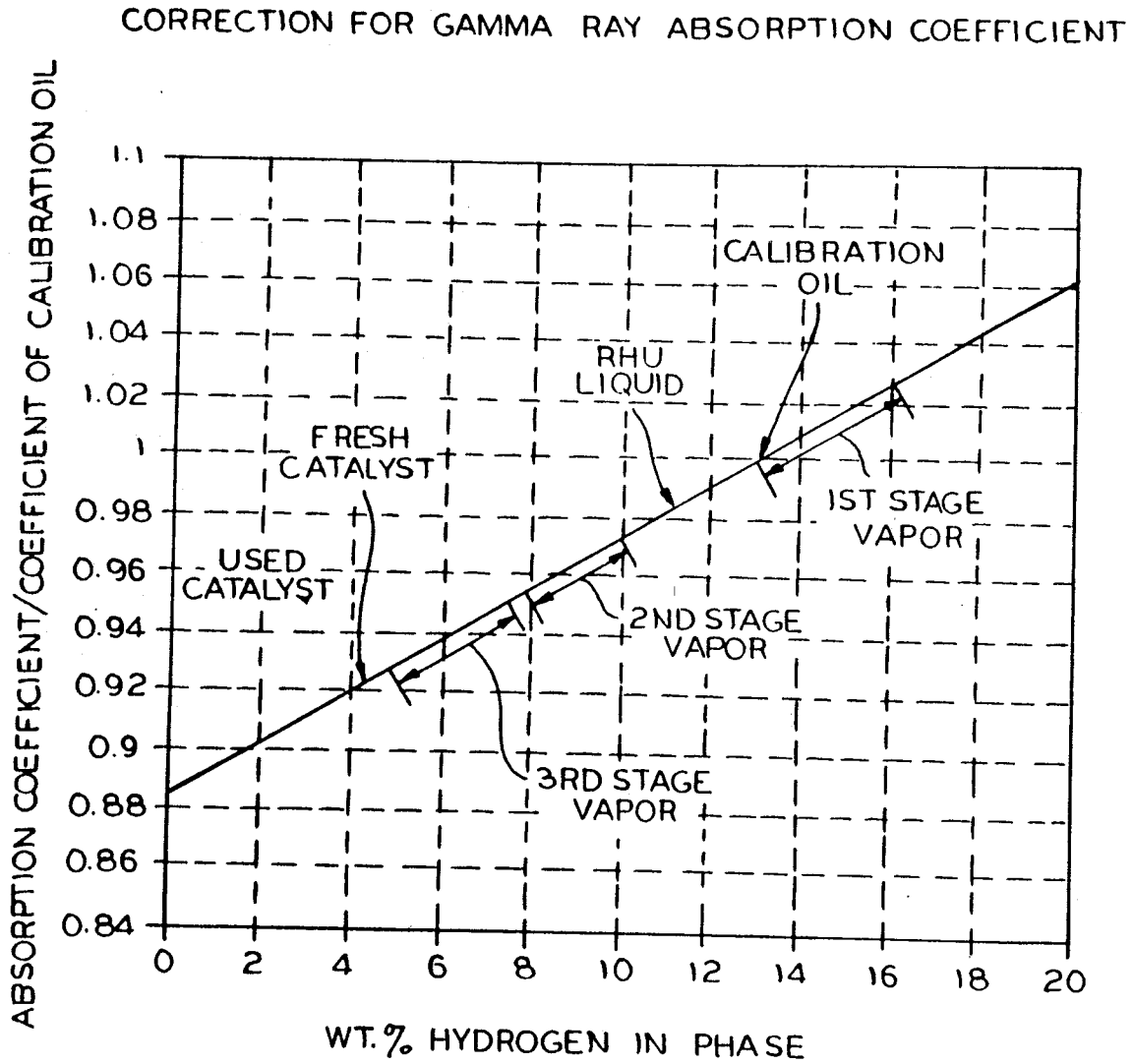
FIG. 2 is a graph showing a correction for gamma-ray absorption of density meters used in a system having three of the reactors of FIG. 1 connected in series.

In practice, the absorption coefficient used in connection with the density meter is determined first by calibrating the instrument with the reactor empty and then by calibrating it with the reactor full of diesel oil. The coefficient used by the meter is then the coefficient of diesel oil containing about 13 wt % hydrogen. FIG. 2 shows how the absorption coefficients of gas, liquid, and solid phases in the reactor compare with the coefficient of diesel oil.

The greatest discrepancy is for used catalyst. Since a soaked catalyst particle contains less than 2 wt % hydrogen, the absorption coefficient for the soaked particle is 10% lower than the coefficient for the calibration oil. Absorption coefficients for second stage and third-stage vapor are about 5% low, while coefficients for liquid and first-stage vapor are within 2% of the calibration coefficient. Corrections for the vapor and liquid phases are negligible compared to corrections for used catalyst.

Step Six

Calculate the density of the solid particle ($\rho_s$). It is generally accurate enough to measure the density of the soaked spent catalyst after it has been withdrawn from the reactor. It may be true that the density of the spent catalyst is a little different from the density of the catalyst with the reactor. However, the differences are negligible.

Step Seven

This step is one of the more important, and perhaps the most important, of the calculations in the inventive process. It has been found by experimentation and observation that the gas holdup $\epsilon_g$ is approximately the same in the freeboard zone (above the top surface 32 of the expanded bed) and in the catalyst bed. Therefore, gas holdup measured by the detector 74 may be used as a starting point for making the calculations because, at the six foot level, it is in the freeboard zone which does not contain any catalyst.

EXAMPLE

This is an example showing that freeboard holdup can be used as estimate of holdup thought the reactor.

$$\begin{aligned} \rho_6 &= \epsilon_{g6}\rho_g + \epsilon_{l6}\rho_l \\ &= \rho_l - \epsilon_{g6}(\rho_l - \rho_g) \end{aligned} \tag{5}$$

At the 20-foot level, the equation for density is $$\begin{aligned} \rho_{20} &= \epsilon_{gb}\rho_g + \epsilon_{lb}\rho_l + \epsilon_s k_s \rho_s \\ &= \rho_l - \epsilon_{gb}(\rho_l - \rho_g) + \epsilon_s(k_s\rho_s - \rho_l) \end{aligned} \tag{6}$$

By combining the two equations (5) and (6), we obtain the difference in gas holdup $$\epsilon_{g6} - \epsilon_{gb} = \frac{\rho_{20} - \rho_6}{\rho_l - \rho_g} - \epsilon_s \frac{k_s\rho_s - \rho_l}{\rho_l - \rho g} \tag{7}$$

To use this equation, we need an estimate of particle holdup ($\epsilon_s$) in the expanded catalyst bed. Particle holdup was calculated from catalyst inventories measured during a turnaround of the reactor.

Figure 3:
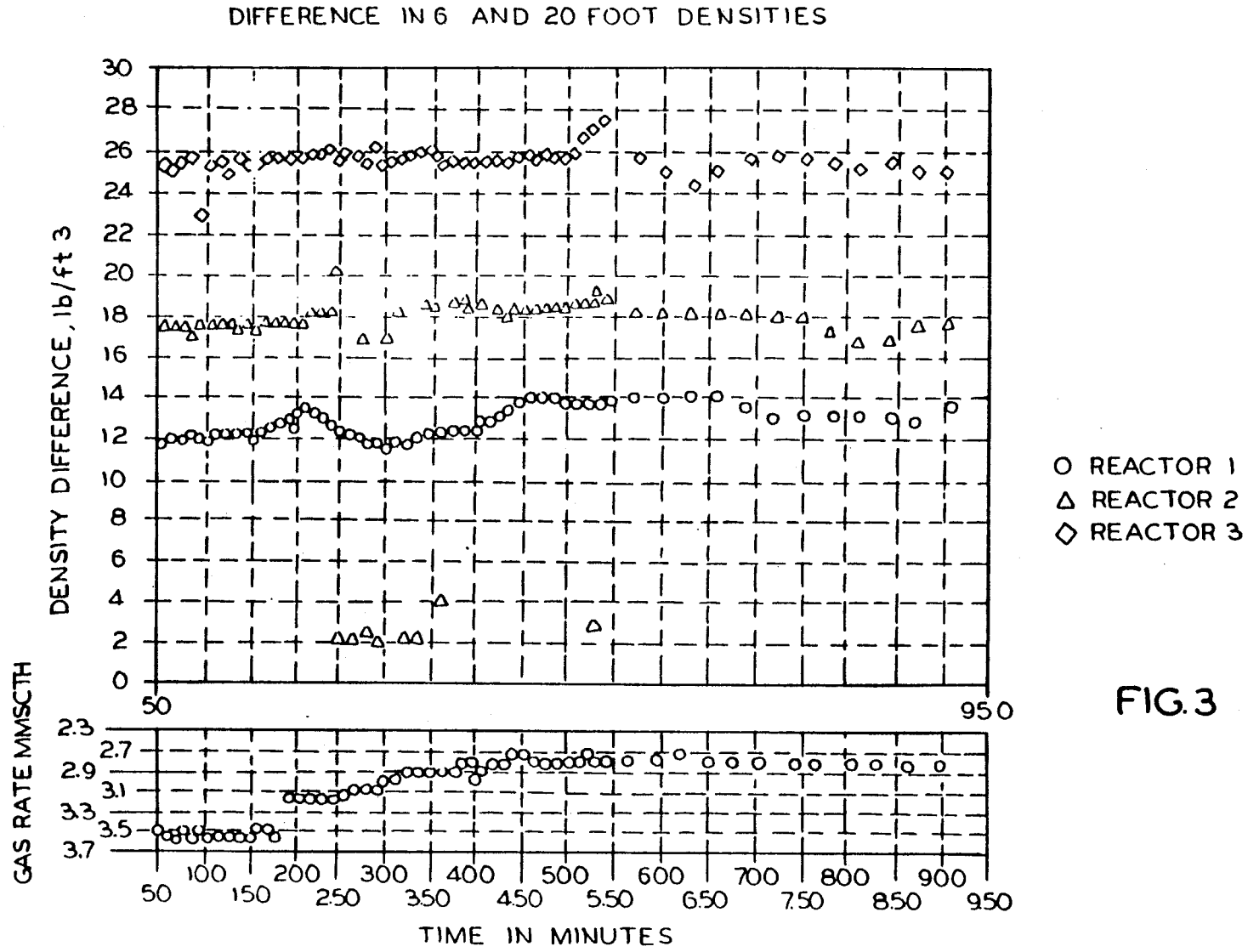
FIG. 3 is a graph showing the differences in densities at 6- and 20-foot levels in the reactor of FIG. 1.

To use equation (7), one also needs to know the difference between the 20- and 6-foot densities as read by detectors 76, 74, respectively. This difference is plotted in FIG. 3 for values taken over the course of most of the test. There was little or no change in the density difference as the gas rate was increased. With the values for these density differences and the particle holdup, one can calculate gas holdup for Equation 7.

In order to compare gas holdup in the freeboard and the catalyst bed one may make a graph showing the relationship between the gas holdup above and in the catalyst bed.

Although, the freeboard and bed gas holdups are not always identical, they are reasonably close. It will be found that, in general, gas holdup in the catalyst bed is close to or slightly higher than gas holdup in the freeboard. Consequently, it has been found that the freeboard gas holdup can be used as an indication of gas holdup throughout the entire reactor. Freeboard holdup can also be used as a substitute for bed gas holdup when the catalyst inventory is calculated from 6- and 20-foot densities.

This discovery simplifies the inventory control and enables it to be calculated with the reactor running. Therefore, to find the factor $\epsilon_{gb}$ for use in equation (1), use the equation $$\rho_6 = \epsilon_{g6}\rho_g + \epsilon_{l6}\rho_l \tag{8}$$

where:

$\epsilon_{g6}$ = the gas hold up, volume fraction.

$\epsilon_{l6}$ = the liquid hold up, volume fraction.

By simple algebraic manipulation, we can change equation 8 to solve for the gas hold up in the freeboard, as follows:

$$\epsilon_{g6} = \frac{\rho_l - \rho_6}{\rho_l - \rho_g} \tag{9}$$

Since the gas hold up is substantially the same through out the reactor, the specialized freeboard hold up $\epsilon_{g6}$ becomes the more general factor $\epsilon_{gb}$.

Step Eight

The catalyst inventory within the reactor is calculated without having to stop the reactor operation.

The calculation procedure is developed from equation (6), the equation for density in the catalyst bed at the 20-foot level. The equation is rearranged to give $$\epsilon_s(k_s\rho_s - \rho_l) = \rho_{20} - \rho_l + \epsilon_{gb}(\rho_l - \rho_g) \tag{10}$$

If we make the reasonable approximation that bed gas holdup is equal to freeboard gas holdup, we have from equation (9)

$$\epsilon_{gb} = \frac{\rho_l - \rho_6}{\rho_l - \rho_g}$$

Substituting this expression into Equation 10 and rearranging it, we obtain an expression for particle holdup at the 20-foot level:

$$\epsilon_s = \frac{\rho_{20} - \rho_6}{k_s\rho_s - \rho_l} \tag{12}$$

Particle holdup can be used to calculate catalyst inventory as long as the catalyst bed is fully and uniformly expanded and as long as the top 32 of the expanded bed is controlled to be between the 8- and 9-foot levels. When these conditions are met, inventory ("INV") can be calculated as $$INV = 100\% \frac{\epsilon_s}{\epsilon_{s0}} \tag{13}$$

where INV = Inventory, vol % of design inventory, stated as a bulk volume by $ft^3$.

$\epsilon_s$ = Calculated particle holdup at 20-foot level, volume fraction.

$\epsilon_{so}$ = Particle holdup of expanded bed at design inventory, volume fraction.

Figure 4:
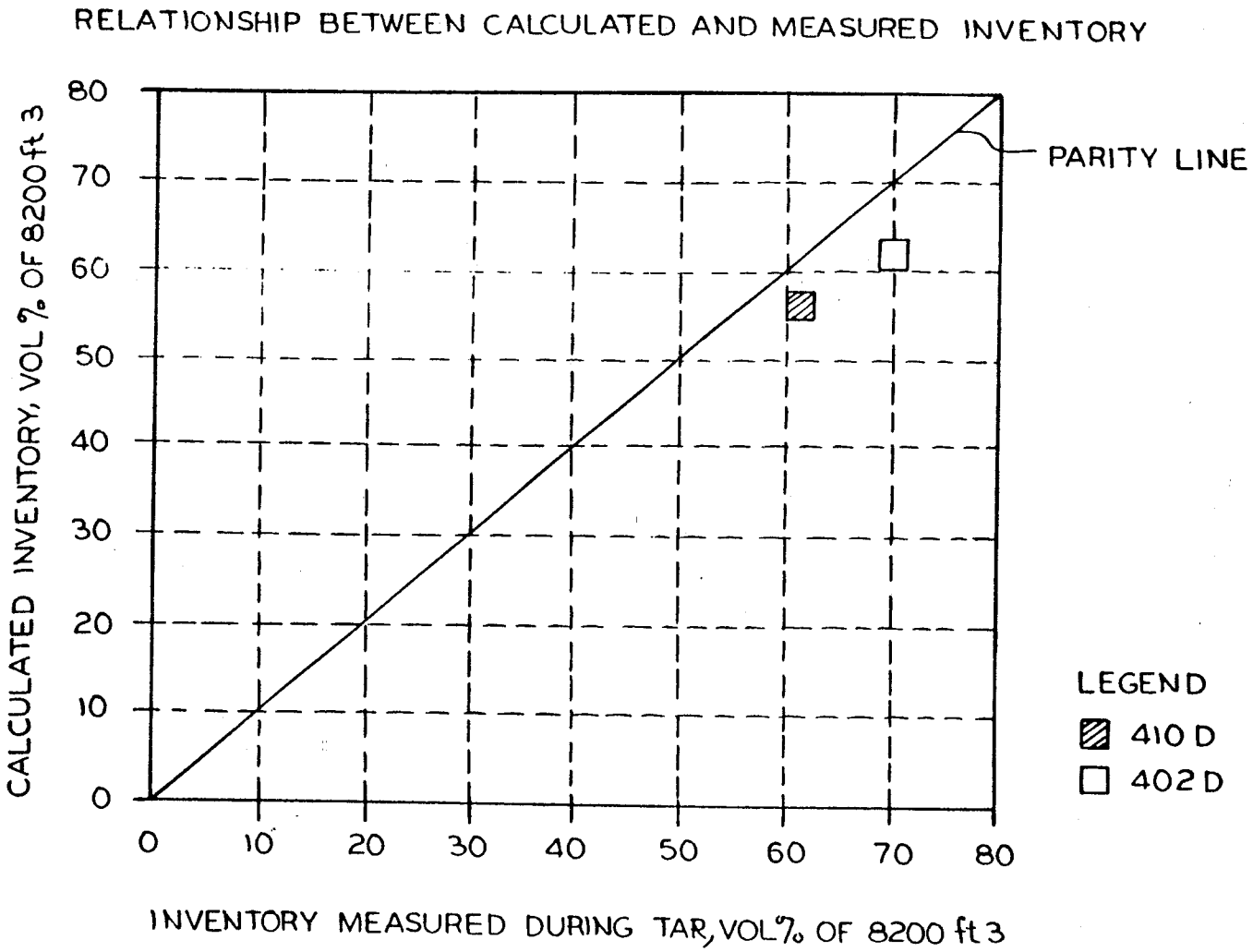
FIG. 4 is a graph showing the relationship between the inventory calculated by the inventive process and the inventory as actually measured during a testing procedure.

During a turnaround, about a month after a gas-rate test was completed, measurements of catalyst inventory were made, in reactors 401D and 402D, based on batches of catalyst that were withdrawn from the reactor. Particle holdups, calculated from these inventory measurements and summarized in Table B, were used to evaluate particle holdups calculated from the 6-and 20-foot densities (see Table C). Catalyst inventories based on the calculated and measured holdups are compared in FIG. 4.

TABLE B

CALCULATION OF PARTICLE HOLDUP

| | Catalyst[a] Withdrawn, ACF (2/4/82-2/9/89) | Adjusted[b] Volume, $ft^3$ | Correction For Additions And Withdrawals, $ft^3$ | Catalyst Volume, $ft^3$ (12/12/88) | Particle[c] Volume, $ft^3$ | Particle[d] Holdup, Vol. Fraction |
|---|---|---|---|---|---|---|
| 401D | 5030 | 5770 | −745 | 5025 | 3065 | 0.285 |
| 402D | 4900 | 5620 | +123 | 5743 | 3500 | 0.325 |

[a]Calculated totals were used.
[b]Actual cubic feet were multiplied by 1.146 to account for the difference in bulk density between fresh and used catalyst.

[c]Particle volume = Bulk volume × $(1 - \epsilon_0)$

= Bulk volume × $(1 - 0.39)$

[d]Particle holdup = $\frac{\text{Particle Volume}}{(A_R)(H_b)}$ $A_R$ — Cross-sectional area (excluding downcomer) = 106.0 $ft^2$
$H_b$ — Bed Height - (110.0 − 8.0 − 0.58)ft = 101.42 ft

TABLE C

CALCULATION OF CATALYST INVENTORY USING 6- AND 20-FOOT DENSITIES[a] (12/12/88)

| | 401D | 402D | 403D |
|---|---|---|---|
| $\rho_s$[b], $lb/ft^3$ | 95 | 110 | 110 |
| $\rho_1$[c], $lb/ft^3$ | 39.5 | 38.25 | 37.0 |
| $k_s$[d], dimensionless | 0.9 | 0.9 | 0.9 |
| $\rho_{20} - \rho_6$[e], $lb/ft^3$ | 12.0 | 17.5 | 25.5 |
| $\epsilon_s$[f], vol. fraction | 0.261 | 0.288 | 0.411 |
| $\epsilon_{so}$[g], vol. fraction | 0.465 | 0.465 | 0.465 |
| Catalyst Inventory[h] vol % of 8200 $ft^3$ | 56.1 | 61.9 | 88.4 |

[a]Method assumes that gas holdup is the same in the freeboard and in the catlyst bed.
[b]Soaked particle density. 401D contains demetallation catalyst. Other reactors contain desulfurization catalyst.
[c]Liquid density.
[d]Correction for gamma-ray absorption coefficient. See FIG. 2
[e]Difference in 20-foot and 6-foot densities. See FIG. 3.
[f]Calculated particle holdup.

$$\epsilon_s = \frac{\rho_{20} - \rho_6}{(k_s\rho_s - \rho_1)}$$

[g]Particle holdup at 100% catalyst inventory.

$$\epsilon_{so} = \frac{8200\ ft^3\ (1 - 0.39)}{(106.0\ ft^3)\ (101.42\ ft)} = 0.465$$

[h]$\text{Inv.} = 100\% \frac{\epsilon_s}{\epsilon_{so}}$

In both cases, agreement was reasonably good although inventories calculated from the 6- and 20-foot densities were low. In reactor 401D, the calculated inventory was low by four percentage points, while in reactor 402D, it was low by 10 points. Better agreement could have been obtained by assuming that bed ga holdup is several points higher than freeboard holdup. This adjustment can be made on a basis of experimental data.

Further testing in commerical types of reactors have shown that the inventive method accurately restores the catalyst level when a batch of spent catalyst is removed from and a new batch of fresh catalyst is added to the reactor. These tests have shown a very accurate reproducibility which may be much more important, in a practical sense, than absolute calculation, in the more abstract and academic sense, of the catalyst inventory.

The advantages of the invention should now be apparent. The on-line procedure can be useful in several ways. There is no need to shut down the reactor to maintain an inventory control. The invention provides a guideline, in addition to pump speed, for deciding whether a batch of catalyst should be added or withdrawn. It can also be used for troubleshooting. Pump speed varies with inventory, but if speed varies while the calculated inventory is constant, there may be some other cause for the variation. The calculated inventory should also indicate whether there is high catalyst attrition or elutriation. During periods when catalyst additions and withdrawals are infrequent, and the true inventory is known to be fairly constant, the calculated inventory may indicate whether any catalyst slumping has occurred.

The on-line procedure can also be used for modeling comparisons. Calculated inventories should give better estimates of catalyst loadings for use in comparing process model results with data from actual performance tests.

Those who are skilled in the art will readily perceive how to modify the invention. Therefore, the appended claims are to be construed to cover all equivalent structures which fall within the true scope and spirit of the invention.

We claim:

1. A computer controlled on-line process carried out during an operation of a petroleum refinery reactor for maintaining a catalyst inventory in an ebullated bed of solid catalyst particles, said bed having therein catalyst, oil, and gas, said process comprising the steps of:

(a) positioning density meters in each of at least two locations relative to said reactor, one of said density meters being at a location in a freeboard region above the ebullated bed in said reactor, a second of said density meters being at a region in said reactor where said catalyst, oil, and gas are present;

(b) feeding signals from said density meters into a computer which is programmed to calculate a catalyst inventory;

(c) measuring the density of said ebullated bed responsive to a reading at said second density meter in said region of said reactor where said catalyst, said oil, and said gas are present;

(d) adding to the density measured in step (c) a first standard factor which was previously calculated to approximately represent vapor density of said gas;

(e) adjusting calculations carried out by said computer to correct for factors influencing readings of said one density meter which indicates the measurements of step (c);

(f) introducing a second standard factor which was previously calculated to represent the approximate density of a solid particle of catalyst in said reactor;

(g) measuring the density in the freeboard region responsive to a reading at said one density meter and calculating gas holdup in the freeboard region;

(h) adding to the calculations a third factor which was precalculated to approximately represent liquid density of said oil;

(i) calculating from said calculations a precalculated gas holdup in said ebullated catalyst bed which is at least as high as the gas holdup in the freeboard region;

(j) calculating particle hold up and a catalyst inventory in said ebullated bed on a basis of data produced during the above steps (c) through (h); and (k) utilizing the calculations of step (j) to maintain the inventory of catalyst in said ebullated bed.

2. The process of claim 1 wherein said measuring of said densities in steps (c) and (g) of claim 1 by said density meters, includes the steps of transmitting gamma rays from a transmitter through at least a part of said reactor and toward a detector positioned in a catalyst reactor zone for step (c) and in a freeboard zone of said reactor for step (g).

3. The process of claim 2 wherein said reactor has a downcomer for recirculating said oil through said ebullated bed of solid catalyst, said gamma ray transmitter/detector for making said measurement in said freeboard zone being mounted in an area having a lower level within a range which extends from an upper limit of substantially two to six feet as measured down from the top of said reactor to a lower limit of about six inches below an intake for said downcomer.

4. The process of claim 2 wherein said gamma ray transmitter/detector for making said freeboard measurement is substantially six feet down from the top of said reactor.

5. The process of claim 2 wherein said gamma ray transmitter/detector for making said measurements of step (c) of claim 1 is substantially twenty feed down from the top of said reactor.

6. The process of claim 2 wherein the factors of step (e) of claim 1 result from gamma-ray absorption during said measurements.

7. The process of claim 1 wherein said factor of step (f) of claim 1 representing the density of a solid catalyst particle is found by measuring the density of spent catalyst after it is removed from said reactor.

8. The process of claim 1 wherein step (j) of claim 1 comprises a further step which includes a calculation based upon the difference between densities measured in the freeboard region in step (g) of claim 1 and in the catalyst bed in step (c) of claim 1.

9. The process of claim 1 wherein the calculated inventory of step (j) of claim 1 comprises a calculation based on a comparison of a known particle hold up at substantially 100% of an inventory in which said reactor is designed to contain a particle hold up for a fully ebullated bed as indicated by data found in steps (c) through (h).

10. A process for inventory control within a reactor of a petroleum refinery, the reactor comprising a housing having a catalytic reaction zone containing a catalyst bed, said housing having a known effective volume, means for introducing new catalyst into said bed, means for introducing fresh and withdrawing spent catalyst to and from said bed in order to maintain an inventory of catalyst in said bed, said catalytic reaction zone containing oil, catalyst, and gas when said reactor is in an operating mode, said reactor including means for ebullating said catalyst bed in said reaction zone, a freeboard zone above said ebullated catalyst bed, means for recirculating at least said oil from a recirculation input near the top of said reactor to a recirculation outlet near the bottom of said reactor, the ebullation expanding said catalyst bed to an upper level which is below said recirculation input and above said recirculation outlet, a first density meter positioned to measure density in said catalyst bed, a second density meter positioned to measure density in said freeboard zone, said process comprising the steps of:

(a) using said second density meter to measure the density of contents of said reactor in the freeboard zone comprising a first area which is far enough above said upper level to be substantially free of any catalyst;

(b) using said first density meter to measure the density of the contents of said reactor in a second area which is substantially representative of the density of said ebullated catalytic bed;

(c) comparing the density measured in the above step (a) with the density measured in the above step (b);

(d) correcting the comparison of the above step (c) by using at least one empirically derived coefficient representing known causes of density reading problems;

(e) operating a computer responsive to the above steps (a) to (d) for calculating the inventory of catalyst in said catalytic bed in response to the corrections of the above step (d); and (f) adjusting the volume of catalyst in said ebullated bed in response to said calculation of said inventory.

11. The process of claim 10 wherein said coefficient of step (d) of claim 10 comprises at least a factor substantially representing a liquid density and a factor substantially representing a vapor density of said gas in said reactor.

12. The process of claim 10 and the added steps of adding new catalyst or withdrawing used catalyst in response to the calculated inventory of step (e) of claim 10, and measuring the density of oil soaked withdrawn catalyst as the coefficient in step (d) of claim 10.

13. The process of claim 10 wherein each of the densities measured in steps (a) and (b) of claim 10 comprises the added steps of transmitting gamma rays through at least two portions of said reactor at each of said first and second areas, respectively, and detecting the gamma rays after they have passed through said portions of said reactor.

14. An on-line inventory control process for use in a petroleum refining reactor while said reactor is in active operation, said process comprising the steps of:

(a) measuring density by the use of density meters at two levels in said reactor, one of said levels being in a freeboard zone above an upper level of an expanded catalyst bed and the other of said levels being substantially representative of the density throughout said expanded catalyst bed;

(b) calculating gas holdup within the catalyst bed on a basis of the density measurement in the freeboard zone based on gas hold up throughout the entire reactor as being uniformly the same as gas hold up in the freeboard zone, the gas holdup further being defined as the volume of the gas within the reactor divided by the effective volume of the reactor;

(c) calculating the approximate soaked density of the catalyst particles by a use of an empirically derived coefficient for the catalyst being used, the empirically derived coefficient being based upon measurements of oil soaked catalyst withdrawn from the reactor;

(d) calculating the catalyst particle holdup $\epsilon_0$ responsive to a particle hold up formula $\epsilon_s$=volume of catalyst particle/volume of reactor;

(e) calculating particle hold up ($\epsilon_{SO}$) for a reactor full of catalyst;

(f) calculating a catalyst inventory responsive to a formula which expresses the ratio of particle holdup of the above step (f),and the measured particle holdup of the above step (a); and (g) adjusting amount of catalyst in said catalyst bed in response to said calculation of step (f) above.

15. An on-line process for maintaining a catalyst inventory in a reactor having an ebullated catalyst bed, said bed having catalyst, oil, and gas, said process comprising the steps of:

(a) calculating an internal effective volume of an ebullated catalytic bed within said reactor by first calculating the volume within said reactor and then subtracting a non-catalyst filled volume inside said reactor;

(b) measuring the density of a two-phase fluid within said reactor at a level which is higher than the top of said ebullated bed of catalyst;

(c) measuring the density of said ebullated bed in a region where said catalyst, oil, and gas are present;

(d) subtracting the measurement derived in step (b) from the measurement derived in step (c) in order to eliminate a component representing the oil from the measurement of step (c);

(e) subtracting from the calculation of step (d) a first correction representing the gas measurement of step (c), said first correction being based upon an empirically derived coefficient of gas within said reactor;

(f) subtracting from the calculations of either step (d) or (e) a second correction substantially representing the density of oil soaked catalyst, said second correction being an empirically derived coefficient based upon measurement of spend catalyst withdrawn from said reactor; and (g) adjusting the inventory of catalyst within said reactor by adding or withdrawing catalyst to or from said bed in response to the calculation of step (f).

16. A process for inventory control within a reactor of a petroleum refinery, said process comprising the steps of:

(a) forming a reactor comprising a housing having a catalytic reaction zone containing a catalyst bed, said reactor having a known effective volume, means for introducing new catalyst into said bed, and means for withdrawing spent catalyst from said bed, said catalytic reaction zone containing oil, catalyst, and gas when said reactor is in an operating mode;

(b) ebullating and expanding said catalyst bed, said reactor including means for recirculating at least some of said oil from a recirculation input near the top of said reactor to a recirculation outlet near the bottom of said reactor, said expanded bed having an upper level which is below said recirculation input and above said recirculation outlet;

(c) measuring the density in said reactor in a first area which is far enough above said upper level to be substantially free of any catalyst;

(d) measuring the density of the contents of said reactor in a second area which is substantially representative of the density of said catalytic bed, (e) subtracting the density measured in step (c) from the density measured in step (d);

(f) correcting the difference calculated by the subtraction of step (e) by a use of at least one coefficient to eliminate known density reading problems; and (g) changing the volume of said catalytic bed by an amount indicated by the corrected difference of step (f).

17. The process of claim 16 wherein said coefficient of step (f) comprises at least a first factor representing hydrogen hydrocarbon vapor and a second factor representing a coefficient for oil soaked condition of said catalyst.

18. The process of claim 17 wherein said changing of catalytic volume of step (g) of claim 16 comprises the added steps of adding new catalyst or withdrawing used catalyst in response to the amount of the corrected difference of step (f) of claim 16.

19. The process of claim 16 wherein each of the densities measured in step (c) of claim 16 and (d) of claim 16 comprises the added steps of transmitting gamma rays through at least a portion of said reactor at said first and second areas, respectively, and detecting the gamma rays after they have passed through said portion of said reactor.

* * * * *

UNITED STATES PATENT AND TRADEMARK OFFICE

CERTIFICATE OF CORRECTION

PATENT NO. : 5,081,039

DATED : January 14, 1992

INVENTOR(S) : Robert D. Buttke, et. al.

It is certified that error appears in the above-indentified patent and that said Letters Patent is hereby corrected as shown below:

Column 3, line 48, "74 76" should read -- 74,76--

Column 5, line 43 "Bg" should read -- Kg --

Column 9, line 62, "ga" should read -- gas --

Signed and Sealed this

Twenty-eighth Day of September, 1993

Bruce Lehman

*Attest:*

BRUCE LEHMAN

*Attesting Officer*

*Commissioner of Patents and Trademarks*